United States Patent [19]

Igata et al.

[11] Patent Number: 4,898,850

[45] Date of Patent: Feb. 6, 1990

[54] PYRIDONE DYESTUFF FOR THERMAL TRANSFER RECORDING AND PRINTING SHEETS AND METHODS EMPLOYING SAME

[75] Inventors: Akitosi Igata; Tamio Mikoda, both of Omuta, Japan

[73] Assignee: Mitsui Toatsu Chemicals, Incorporated, Tokyo, Japan

[21] Appl. No.: 278,857

[22] Filed: Dec. 2, 1988

[30] Foreign Application Priority Data

Dec. 3, 1987 [JP] Japan ..... 62-304601
Oct. 18, 1988 [JP] Japan ..... 63-260653

[51] Int. Cl.[4] ..... B41M 5/035; B41M 5/26

[52] U.S. Cl. ..... 503/227; 8/471; 428/195; 428/211; 428/913; 428/914

[58] Field of Search ..... 8/471; 427/150–152; 428/913, 914, 195, 211; 503/227

[56] References Cited

U.S. PATENT DOCUMENTS 4,808,568 2/1989 Gregory et al. ..... 503/227

FOREIGN PATENT DOCUMENTS 54-5029 7/1968 Japan ..... 503/227
51-139869 5/1975 Japan ..... 503/227
53-10778 7/1976 Japan ..... 503/227
54-23782 7/1977 Japan ..... 503/227
61-12393 6/1984 Japan ..... 503/227
61-12394 6/1984 Japan ..... 503/227
3039380 2/1988 Japan ..... 503/227

*Primary Examiner*—Bruce H. Hess
*Attorney, Agent, or Firm*—Millen, White & Zelano

[57] ABSTRACT

Thermally printable sheets, such as paper coated with a polymer such as a polyester or a polyacrylonitrile are colored yellow by a thermal transfer printing process, e.g., using a decal printing transfer sheet, which employs as a yellow dyestuff a 2-pyridone of the formula

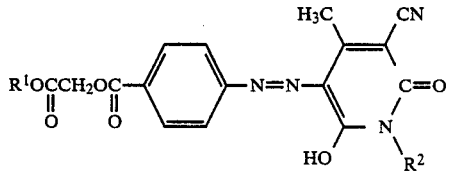

wherein $R^1$ is a lower alkyl, and $R^2$ is lower alkyl, lower alkoxy-lower alkyl, carbocyclic aryl-lower alkyl, cyclo-lower alkyl, lower alkenyl or lower alkoxycarbonylmethyl.

25 Claims, No Drawings

PYRIDONE DYESTUFF FOR THERMAL TRANSFER RECORDING AND PRINTING SHEETS AND METHODS EMPLOYING SAME

BACKGROUND OF THE INVENTION (1) Field of the Invention

The present invention relates to the field of thermal transfer printing, more particularly wherein a yellow pattern or images are printed onto an acceptable sheet.

The present invention can be applied to the thermal transfer printing process of synthetic fibers and thermal transfer type recording systems, viz., information recording means, and it can provide various good color effects such as color fastness against light and enables the production of vividly colored images.

(2) Description of the Prior Art

Known yellow dyestuffs for heat transfer printing (Japanese Patent Publication No. 5029/1979) are styryl dyestuffs represented by the formula (2)

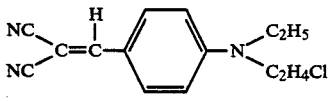

(2)

pyrazole dyestuffs (reference literature: Japanese Patent Laid-open Nos. 139869/1976 and 10778/1978) represented by the formalae (3) and (4)

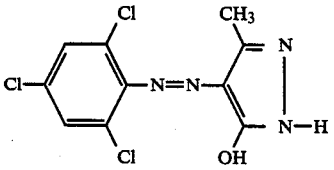

(3)

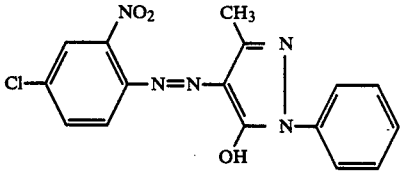

(4)

pyridone dyestuffs (Japanese Patent Laid-open Publication No. 23782/1979) represented by the formula (5)

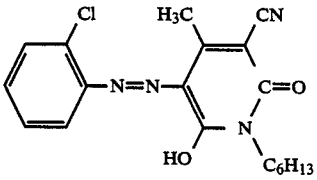

(5)

and other dyestuffs.

Furthermore, as the coloring material for recording information, there has been suggested the utilization of Color Index Disperse Yellow 54 represented by formula (6):

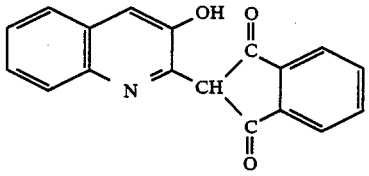

(6)

Disclosed by the inventors of the present application (Japanese Patent Laid-open Publication Nos. 12393/198767 and 12394/1986) are pyrasolone and pyrazole dyestuffs represented by the formulae (7) and (8):

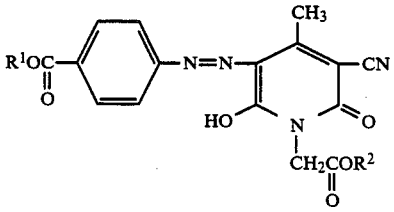

(7)

wherein $R^1$ is lower alkyl and $R^2$ is lower alkyl or lower alkoxy and

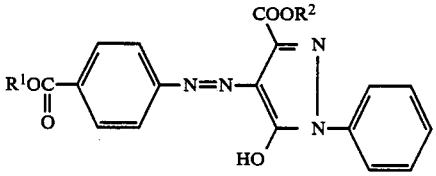

(8)

When a yellow coloring material is used on synthetic fibers or record papers in accordance with a heat transfer system, important criteria of its quality are various color factors such as color fastness against light and color value. The color fastness factors and color value of the above-mentioned known coloring materials are poor. In addition, the color tones of these coloring materials are also not vivid.

OBJECTS OF THE INVENTION

It is an object of this invention to provide yellow pyridone dyestuffs which are useful as coloring materials in heat transfer printing processes.

Another object is to provide heat transfer printing compositions and printing sheets employing as a yellow dyestuff a pyridone of this invention.

Other objects will be apparent to those skilled in the art to which this invention pertains.

SUMMARY OF THE INVENTION

In a composition aspect, this invention relates to coloring compositions adapted for printing a surface by thermal transfer printing comprising a yellow pyridone compound of general formula (1)

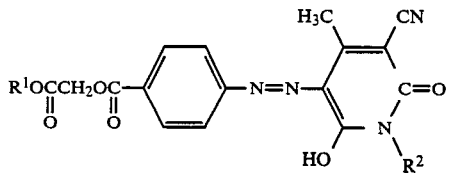

(1)

wherein $R^1$ is a lower alkyl group, and $R^2$ is an alkyl group, alkoxyalkyl group, aralkyl group, cycloalkyl group, alkenyl group or lower alkoxycarbonylmethyl group.

In an article of manufacture aspect, this invention relates to a transfer printing sheet having on a face thereof a heat-releasable coating or pattern comprising a yellow pyridone of general formula (1).

In a method aspect, this invention relates to a thermal transfer printing method which comprises affixing a compound of general formula (1) with heat to a printable substrate such as paper or fabric.

In a preferred method aspect, this invention relates to a gas phase thermal transfer printing method in which a volatilizable dyestuff in the form of a heat-releasable coating on a surface of a transfer substrate is pressed against a face of a printable substrate, while the transfer substrate is heated to the volatilization temperature of the dyestuff, thereby transferring the pattern of the dyestuff from the transfer substrate to the printable substrate, wherein the dyestuff is a yellow pyridone of the formula

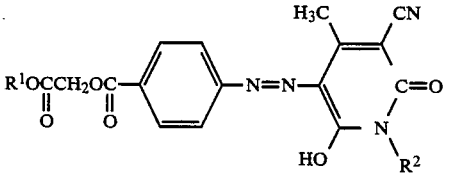

(1)

wherein $R^1$ is lower alkyl and $R^2$ is lower alkyl, alkoxyalkyl, aralkyl, cycloalkyl, alkenyl or lower alkoxycarbonylmethyl.

DETAILED DESCRIPTION

In the general formula (1), typical examples of $R^1$ lower alkyl groups are those of 1 to 8, preferably 1 to 4 carbon atoms, e.g., methyl, ethyl, and branched- and straight-chain propyl and butyl. Typical examples of $R^2$ alkyl groups are straight- and branched-chain lower alkyl of 1 to 8, carbon atoms, e.g., methyl, ethyl, propyl, butyl, pentyl, hexyl, heptyl and octyl. Examples of $R^2$ alkoxyalkyl groups are those wherein alkoxy is lower alkoxy and alkyl is as defined above, e.g., methoxymethyl, methoxyethyl, 3-methoxypropyl, methoxybutyl, methoxypentyl, methoxyhexyl, methoxyheptyl, ethoxymethyl, ethoxyethyl, ethoxypropyl, ethoxybutyl, ethoxypentyl, ethoxyhexyl, propoxymethyl, propoxyethyl, propoxypropyl, propoxybutyl, propoxypentyl, butoxymethyl, butoxyethyl, butoxypropyl, butoxybutyl, pentyloxymethyl, pentyloxyethyl, pentyloxypropyl, hexyloxymethyl, hexyloxyethyl and heptyloxymethyl. Examples of $R^2$ aralkyl groups are wherein the alkyl group thereof is lower alkyl, e.g., benzyl and phenethyl. Examples of $R^2$ cycloalkyl groups are those of 3 to 8 ring carbon atoms, e.g., those of 7 to 11 carbon atoms, such as cyclopropyl, cyclobutyl, cyclopentyl, cyclohexyl, cycloheptyl and cyclooctyl. Examples of $R^2$ alkenyl groups are those of up to 8 carbon atoms, e.g., allyl, 1-butenyl, 2-butenyl, 2butenylene and 2-methylallyl. Examples of $R^2$ lower alkoxycarbonylmethyl groups are methoxycarbonylmethyl, ethoxycarbonylmethyl, propoxy-carbonylmethyl and butoxycarbonylmethyl.

Because the compounds of general formula (1) sublime when heated, they can be applied to a fabric or sheet by heating alone. However, the heat transfer printing compositions of this invention ordinarily comprise, in addition to a yellow dyestuff of general formula (1), at least one organic impregnating agent which facilitates the adherence of the dyestuff to the surface to be printed therewith, e.g., a binder such as, for example, ethyl cellulose, styrol resin powder, ethylhydroxycellulose, colophonium resin powder, polyvinylbutyral and polyesters.

The dyestuff can also be contained in a heat meltable resin-wax composition. Resins which can be employed include polyvinyl acetate, polyethyl acrylate, polymethyl acrylate, polyethyl methacrylate, polypropyl methacrylate, polybutyl methacrylate, styrenebutadiene, acrylonitrilebutadiene, polychloroprene rubbers, polyvinyl butyral, ethyl cellulose, and polyvinyl acetate vinyl stearate copolymer. The wax component can be beeswax, candelilla wax, carnauba wax, hydrogenated castor oil, montan wax, paraffin wax, low molecular weight polyethylene, oxidized microcrystalline wax, and hard wax or derivatives thereof obtained from the Fischer-Tropsch synthesis.

Although the dyestuffs of general formula (1) are ordinarily employed to print a yellow pattern on an acceptable sheet, one can produce a full-colored graphic hard-copy by successive multiple printing with, e.g., cyanine and magenta dyestuffs, by thermal transference of video or computer images from a conventional transfer substrate.

The compounds represented by the general formula (1) can be prepared by the following process:

A pyridone of general formula (A) is synthesized from ethyl acetoacetate, ethyl cyanoacetate and an amine of the general formula $NH_2R^2$, wherein $R^2$ has a value given above in a known manner in accordance with the following chemical equation:

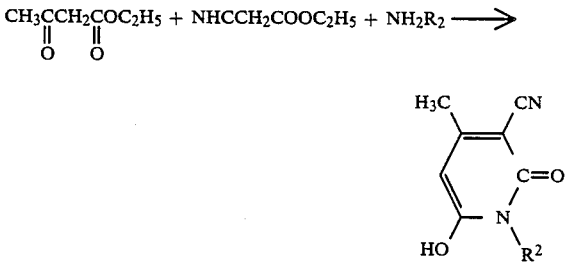

The thus-synthesized pyridone is diazo-coupled with para-aminobenzoic acid in a known manner in order to obtain a base of general formula (B). The latter is then reacted with an ester of monochloroacetic acid of general formula (C) wherein $R^1$ has a value given above, to prepare a compound having the general formula (1) in accordance with the following reaction scheme

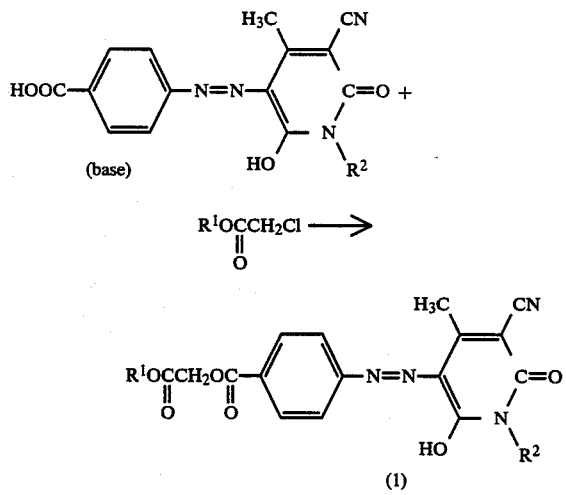

Compounds of general formula (1) have excellent heat stability and transfer velocity, which properties are required for use as a coloring material in transfer printing. These compounds sublimate when heated. Thus, it can be bonded onto a surface by sublimation and color the secured positions yellow.

The transfer printing sheets of this invention are adapted for use in the heat transfer printing of paper and fabrics and comprise a substrate sheet having heat releasably printed in a pattern on a face thereof a layer or coating of a compound of general formula (1), alone or in admixture with a carrier which facilitates the release of the coating from the substrate or the adherence of the released compound of general formula (1) to the fabric or sheet to be printed.

Procedures for the heat transfer printing synthetic fibers are described in, for example, French Patent Nos. 1,213,330 and 1,585,119 and German Patent No. 1769757, and dyestuffs, regulators and auxiliary carriers used in the procedures are disclosed in German Patent Laid-open Nos. 1771813 and 1771812. In U.S. Pat. No. 3,616,015 a label-carrying web such as a paper sheet includes a heat transferable label composed of a wax release layer affixed to a surface of the paper sheet and an ink design layer superimposed onto the wax release layer. U.S. Pat. No. 3,616,176 discloses a laminate consisting of a base sheet, with a polyamide layer covering the base sheet and a decorative ink layer covering the polyamide layer. U.S. Pat. No. 3,516,842 discloses a heat transfer label which is heat transferable to a plastic bottle from a paper carrier sheet having a wax-like release layer consisting of a slightly oxidized, low molecular weight polyethylene wax, an unoxidized hard wax which, after deposition on the paper carrier has been subjected to corona discharge, a blend of ethylene-vinyl acetate (EVA) copolymer and a paraffin wax. U.S. Pat. No. 2,989,413 discloses a heat transferable laminate employing a release layer which employs an unoxidized Fisher-Tropsch wax. U.S. Pat. No. 2,862,832 discloses a heat transferable decal having a release layer which employs an oxidized wax. U.S. Pat. No. 2,990,311 discloses a heat transferable decal having a release transfer layer consisting of a mixture of a crystalline wax and a synthetic thermoplastic film-forming resin, principally an organic linear thermoplastic film-forming resin which is substantially water insoluble. U.S. Pat. No. 4,536,434 employs a hot melt printing composition which does not contain a solvent. U.S. Pat. No. 4,555,436 employs a heat transferable laminate wherein an ink design image present in a release formulation which contains a montan wax, a resin ester or hydrocarbon resin, a solvent and ethylene-vinyl acetate copolymer having low vinyl content. All of these patent publications, whose disclosures are incorporated herein by reference, disclose thermal printing techniques which can be applied to the present invention.

When the coloring material of the present invention is used in a heat transfer type recording system which is an information recording means, images can be transferred by a thermal head to a print paper, i.e., a color sheet, which may be prepared, for example, by forming a fine dispersion or solution of a compound of general formula (1) in a suitable vehicle and then coating a base material with the resultant dispersion or solution.

The substrate of the heat transfer printing sheet of this invention can be any material to which a compound of general formula (1) or a heat transfer printing composition comprising it can be heat-releasably affixed thereto as a coating or in a predetermined pattern, such as conventional plain or coated sulfite or kraft paper or a film of a polymer having a softening point high enough to resist loss of structural integrity during the heat transfer step.

The materials to which a compound of general formula (1) can be applied by a heat transfer printing method in a pattern or image to an acceptable surface, including sheet materials such as paper and woven, non-woven and knitted fabrics, including fabrics difficult to dye with conventional aqueous dyestuffs, e.g., polyesters and polyacrylonitriles, and coated sulfite bond or kraft paper, e.g., coated with a hydrophobic polymer, such as polyamide, polyester, e.g., PET, polyacetate, polyvinyl acetate, etc.. As part of an appropriate heat transfer printing composition, it can also be bonded to coated and uncoated metal, glass, ceramic and polymer surfaces.

Contemplated equivalents of this invention are printing compositions and methods and heat-transfer sheets which comprise as a yellow dyestuff another pyridone otherwise corresponding to formula (1) wherein Rand-/or $R^2$ is another generally equivalent group which imparts comparable properties to the resulting yellow dyestuff, e.g., those wherein $R^1$ is an alkyl of more than 8 carbon atoms or $R^2$ is an alkyl, alkoxyalkyl, aralkyl, cycloalkyl alkenyl or alkoxycarbonylmethyl group which contains more than 8 carbon atoms in the aliphatic chain, or wherein either or both of $R^1$ and $R^2$ bear one or more non-interfering substituents, such as, for example, a halogen atom, a lower alkyl, lower alkoxy, cyano, nitro, lower-alkoxycarbonyl, alkyl or aryl amide or carbamide group.

Without further elaboration, it is believed that one skilled in the art can, using the preceding description, utilize the present invention to its fullest extent. In the examples given below, parts and percentages are based on weight.

EXAMPLE 1

A printing composition, composed of 10 parts of the compound of general formula (1), wherein $R^1$ is n-$C_4H_9$ and $R^2$ is 3-methoxypropyl, 5 parts of ethyl cellulose, 70 parts of ethyl alcohol, 20 parts of ethyl acetate and 5 parts of ethylene glycol, was printed onto a sheet of paper by the flexographic printing process, in a preselected pattern, followed by drying. The dried paper was then placed on the face of a polyester fabric to be printed so that the printed surface of the fabric was in direct contact with a face of the fabric, and the resulting laminate was passed through a calender at 200 ° C. for 30 seconds. As a result, the coloring material was heat-transferred to the PET coated fabric and a yellow print was obtained.

The thus-obtained print was then subjected to a light fade resistance test at a temperature of 63±2° C. by the use of Xenon-fade Meter (made by Suga Shikenki Co., Ltd.). The print scarcely discolored, which indicated that the print was excellent in light resistance. Additionally, the print was also good in image stability at high temperatures and high humidities.

Following the procedure of Example 1, comparable results are obtained using a polyethylene terephthalate (PET) coated paper as the sheet material and heating the laminate at 130° C. for 20 seconds.

EXAMPLE 2

A printing composition, consisting of 5 parts of a compound of general formula (1) wherein $R^1$ is ethyl and $R^2$ is 3-methoxypropyl, 20 parts of polymerized styrol and 80 parts of toluol, was printed in a selected pattern onto a sheet of printing paper by the copper gravure printing process, followed by drying. Afterward, the print pattern on the dried paper was heat-transferred to a polyacrylonitrile fabric by the same procedure as in Example 1 at 190° C. for 25 seconds, so that a yellow print was obtained on the fabric.

The light resistance and image stability of the thus-obtained print were tested in the same manner as in Example 1. The quality of the print was good, as in Example 1.

Comparable results are obtained by heat transferring the print pattern onto a polyacetate coated paper in the same manner by heating the laminate at 145° C. for 25 seconds.

EXAMPLE 3

A printing composition, composed of 21 parts of formula (1) wherein $R^1$ is methyl and $R^2$ is 3-methoxypropyl, 318 parts of methyl ethyl ketone, 125 parts of toluene and 30 parts of ethylhydroxyethyl cellulose, was printed onto a sheet of printing paper by the rotary film printing process, followed by drying. Afterward, the print pattern on the dried paper was transferred to a white polyester fabric by the same procedure as in Example 1 at 210° C. for 30 seconds, so that a yellow print on the fabric was obtained.

The light resistance and image stability of the thus-obtained print were tested in the same manner as in Example 1. The quality of the print was good, as in Example 1.

Comparable results are obtained by heat transferring the print pattern onto a polyvinyl coated paper in the same manner by heating the laminate at 110° C. for 30 seconds.

EXAMPLE 4

A printing composition, composed of 10 parts of the compound of general formula (1), wherein $R^1$ is ethyl and $R^2$ is n-butoxycarbonylmethyl, and 90 parts of a varnish comprising 40 parts of phenol-modified colophonium resin, 20 parts of vegetable drying oil, 10 parts of long oil alkyd resin, 25 parts of a mineral oil, 10 parts of an aerosol and 2 parts of cobalt desiccant, was printed in a selected pattern onto a transfer printing paper by the offset printing process. The dried paper was placed against the face of a polyacrylonitrile fabric so that the printed surface of the paper was in direct contact with a face of the fabric, and the resulting laminate was then treated on a leaf press at 125° C. for 25 seconds. A yellow print having good color fastness against light and humidity was obtained on the fabric.

The light resistance and image stability of the thus-obtained print were tested in the same manner as in Example 1. The quality of the print was good, as in Example 1.

Comparable results are obtained by heat transferring the print pattern to a polyacrylonitrile fabric in the same manner.

EXAMPLE 5

A printing composition, composed of 21 parts of the compound of general formula (1), wherein $R^1$ is ethyl and $R^2$ is ethoxycarbonylmethyl, 318 parts of methyl ethyl ketone, 125 parts of toluene and 30 parts of ethylhydroxyethyl cellulose, was printed onto paper by the rotary film printing process, followed by drying. The resulting print pattern on the dried paper was transferred to a polyester fabric by the same procedure as in Example 2 at 210° C. for 20 seconds, so that a yellow print having good color fastness against humidity was obtained on the fabric.

The light resistance and image stability of the thus-obtained print were tested in the same manner as in Example 1. The quality of the print was good, as in Example 1.

Comparable results are obtained by heat transferring the print pattern to a PET coated paper in the same manner by heating the laminate at 145° C. for 20 seconds.

EXAMPLE 6

A printing composition, composed of 10 parts of the compound of general formula (1), wherein $R^1$ is ethyl and $R^2$ is methoxycarbonylmethyl, and 90 parts of a varnish comprising 10 parts of ethyl cellulose, 75 parts of ethyl alcohol, 20 parts of ethyl acetate and 5 parts of ethylene glycol, was printed in a selected pattern onto a transfer paper by the intaglio printing process and then dried. The dried paper was placed against the face of a polyester fabric so that the printed surface of the dried paper was in direct contact with the fabric, and the laminate was then passed through a calendar at 210° C. for 30 seconds. As a result, the pattern was transferred to the fabric and a yellow print having good color fastness against light and humidity on the fabric was obtained.

The light resistance and image stability of the thus-obtained print were tested in the same manner as in Example 1. The test results were good, as in Example 1.

Comparable results are obtained by heat transferring the print pattern to a polyester coated paper in the same manner by heating to 115° C. for 30 seconds.

EXAMPLE 7

A pattern was printed onto a paper using the printing composition prepared in Example 1, followed by drying, in order to obtain a ribbon. This ribbon was then passed between a polyester coated paper and a heating element while the latter element was pressed against the ribbon, so that the dyestuff was transferred to the coated paper, thereby reproducing sharp characters and images on the coated paper.

The light resistance and image stability of the thus-obtained coated paper were tested in the same manner as in Example 1. The test results were good as in Example 1.

EXAMPLES 8 to 29

By the use of various compounds shown in Table 1, yellow prints are obtained in the same manner as in Example 1. The light resistance test is carried out on the obtained prints by the same procedure as in Example 1. The prints scarcely change in the test which indicates that they have excellent image stability at high temperature and high humidities. The light resistance of each of the resulting prints is estimated to be good.

TABLE 1

| | Substituents in General Formula (1) | | Light |
|---|---|---|---|
| | $R^1$ | $R^2$ | Resistance |
| Example 8 | $C_2H_5$— | $CH_3$— | Excellent |
| Example 9 | $C_3H_7$— | n-$C_3H_6$— | Excellent |
| Example 10 | $C_3H_7$— | iso-$C_4H_9$— | Excellent |
| Example 11 | $C_4H_9$— | n-$C_8H_{17}$— | Excellent |
| Example 12 | $C_4H_9$— | $C_2H_5OC_2H_4$— | Excellent |
| Example 13 | $C_2H_5$— | $C_2H_5OC_6H_{12}$—(n) | Excellent |
| Example 14 | iso-$C_3H_7$— | n-$C_3H_7OCH_2$— | Excellent |
| Example 15 | $CH_3$— | n-$C_3H_7OC_4H_8$— | Excellent |
| Example 16 | $C_2H_5$— | n-$C_4H_9OC_2H_4$— | Excellent |
| Example 17 | $C_4H_9$— | n-$C_4H_9OC_4H_8$— | Excellent |
| Example 18 | $C_2H_5$— | n-$C_5H_{11}OCH_2$— | Excellent |
| Example 19 | $CH_3$— | n-$C_5H_{11}OC_3H_6$— | Excellent |
| Example 20 | $C_2H_5$— | n-$C_6H_{13}OC_2H_4$— | Excellent |
| Example 21 | $CH_3$— | n-$C_7H_{15}OCH_2$— | Excellent |
| Example 22 | $C_4H_9$— | $C_3H_5$— | Excellent |
| Example 23 | $C_2H_5$— | $C_5H_9$— | Excellent |
| Example 24 | $CH_3$— | $C_8H_{15}$— | Excellent |
| Example 25 | $C_2H_5$— | $CH_2$=$CHCH_2$— | Excellent |
| Example 26 | $C_3H_7$— | $CH_3CH_2CH$=$CH$— | Excellent |
| Example 27 | $C_2H_5$— | benzyl- | Excellent |
| Example 28 | $C_2H_5$— | phenethyl- | Excellent |
| Example 29 | $C_2H_5$— | cyclohexyl- | Excellent |

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a gas phase thermal transfer printing method in which a volatilizable dyestuff in the form of a heat-releasable coating on a surface of a transfer substrate is pressed against a face of a printable substrate, while the transfer substrate is heated to the volatilization temperature of the dyestuff, thereby transferring the pattern of the dyestuff from the transfer substrate to the printable substrate, the improvement wherein the dyestuff is a yellow pyridone of the formula

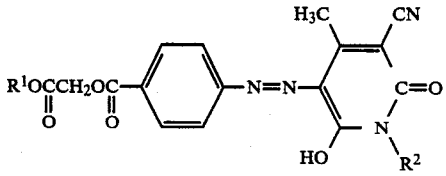

wherein $R^1$ is lower alkyl and $R^2$ is lower alkyl, lower alkoxy-lower alkyl, carbocyclic aryl-lower alkyl, cyclo-lower alkyl, lower alkenyl or lower alkoxycarbonyl-methyl.

2. A method according to claim 1, wherein the printable substrate is a polymer coated paper.

3. A method according to claim 2, wherein the polymer is polyester or polyacrylonitrile.

4. A method according to claim 1, wherein the transfer substrate is paper.

5. A method according to claim 4, wherein the coating of the dyestuff is applied to the transfer substrate as a solution or dispersion in a volatile vehicle and the transfer substrate is then dried before being pressed against the printable substrate.

6. A method according to claim 1, wherein $R^1$ is lower alkyl.

7. A method according to claim 1, wherein $R^1$ is ethyl.

8. A method according to claim 1, wherein $R^2$ is lower alkoxy-lower alkyl.

9. A method according to claim 1, wherein $R^2$ is 3-methoxypropyl.

10. A method according to claim 1, wherein $R^2$ is lower alkoxycarbonylmethyl.

11. A method according to claim 1, wherein $R^1$ is lower-alkyl of 1 to 4 carbon atoms and $R^2$ is methoxycarbonylmethyl, ethoxycarbonylmethyl, n-butoxycarbonyl-methyl or 3-methoxypropyl.

12. A method according to claim 11, wherein the printable substrate is a coated paper, wherein the transfer substrate is paper and wherein the coating of the dyestuff is applied to the transfer substrate as a solution or dispersion in a volatile vehicle and the transfer substrate is then dried before being pressed against the printable substrate.

13. A method according to claim 1, wherein the heat-releasable coating comprises at least one organic impregnating agent which facilitates the adherence of the dyestuff to the printable substrate.

14. A method according to claim 13, wherein the impregnating agent is a binder.

15. A method according to claim 14, wherein the binder is selected from the group consisting of ethyl cellulose, styrol resin powder, ethylhydroxycellulose, colophonium resin power, polyvinylbutyral, and polyesters.

16. In a thermal transfer printing sheet comprising a substrate sheet having on a surface thereof a heat-releasable coating of a volatilizable dyestuff in a pattern, the improvement wherein the dyestuff is a yellow pyridone of the formula

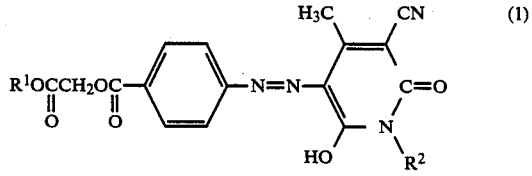

wherein $R^1$ is lower alkyl and $R^2$ is lower alkyl, lower alkoxy-lower alkyl, carbocyclic aryl-lower alkyl, cyclo-lower alkyl, lower alkenyl or lower-alkoxycarbonyl-methyl.

17. A transfer sheet according to claim 16, wherein the substrate sheet is paper.

18. A transfer sheet according to claim 16, wherein $R^1$ is lower alkyl.

19. A transfer sheet according to claim 16, wherein $R^1$ is ethyl.

20. A transfer sheet according to claim 16, wherein $R^2$ is lower alkoxy-lower alkyl.

21. A transfer sheet according to claim 16, wherein $R^1$ is ethyl and $R^2$ is ethoxycarbonylmethyl, n-butoxycarbonylmethyl or 3-methoxypropyl.

22. A transfer sheet according to claim 21, wherein the substrate sheet is paper.

23. A transfer sheet according to claim 16, wherein the heat-releasable coating comprises at least one organic impregnating agent which facilitates the adherence of the dyestuff to the printable substrate.

24. A transfer sheet according to claim 23, wherein the impregnating agent is a binder.

25. A transfer sheet according to claim 24, wherein the binder is selected from the group consisting of ethyl cellulose, styrol resin power, ethylhydroxycellulose, colophonium resin power, polyvinylbutyral, and polyesters.

* * * * *